US007833324B2

(12) United States Patent
Chen et al.

(10) Patent No.: US 7,833,324 B2
(45) Date of Patent: Nov. 16, 2010

(54) WET ELECTROSTATIC PRECIPITATOR WITH CONDENSATION-GROWTH CHAMBER

(75) Inventors: Tzu-Mimg Chen, Hsinchu (TW); Shou-Nan Li, Nantou County (TW); Chuen-Jinn Tsai, Hsinchu County (TW); Sheng-Jen Yu, Taipei (TW); Guan-Yu Lin, Taipei County (TW)

(73) Assignee: Industrial Technology Research Institute, Chutung Hsinchu (TW)

( * ) Notice: Subject to any disclaimer, the term of this patent is extended or adjusted under 35 U.S.C. 154(b) by 242 days.

(21) Appl. No.: 12/271,172

(22) Filed: Nov. 14, 2008

(65) Prior Publication Data

US 2009/0314162 A1 Dec. 24, 2009

(30) Foreign Application Priority Data

Jun. 18, 2008 (TW) ..... 97122768 A

(51) Int. Cl.
*B03C 3/78* (2006.01)

(52) U.S. Cl. ..... 96/45; 95/73; 95/75; 95/78; 96/47; 96/48; 96/49; 96/50; 96/62; 96/69; 96/74; 96/88; 96/96; 96/99

(58) Field of Classification Search ..... 96/43–50, 96/52, 53, 62, 69, 74, 88, 96, 98, 99; 95/73, 95/75, 78
See application file for complete search history.

(56) References Cited

U.S. PATENT DOCUMENTS 1,334,231 A * 3/1920 Davidson ..... 96/49
2,192,172 A * 3/1940 Anderson ..... 95/75
2,192,249 A * 3/1940 White ..... 95/75
3,238,702 A * 3/1966 De Seversky ..... 96/45
3,765,154 A * 10/1973 Hardt et al. ..... 96/88
4,597,780 A * 7/1986 Reif ..... 96/45
5,395,430 A 3/1995 Lundgren et al.
5,626,652 A * 5/1997 Kohl et al. ..... 96/45

(Continued)

FOREIGN PATENT DOCUMENTS

JP 51-110477 A * 9/1976

OTHER PUBLICATIONS

Pasic, H., et al.,"Membrane Tubular Wet Electrostatic Precipitators", Filtration & Separation, Nov. 2006, pp. 16-18.

(Continued)

*Primary Examiner*—Richard L Chiesa
(74) *Attorney, Agent, or Firm*—Browdy and Neimark, PLLC

(57) ABSTRACT

A wet electrostatic precipitator is disclosed to include a condensation-growth chamber, a precipitation chamber connecting with the condensation-growth chamber, three dual-sleeve members mounted in the precipitation chamber, three discharge electrodes connecting with the dual-sleeve members, two insulating members covering on the inner surface of the precipitation chamber, and two ground electrodes mounted on the outside of the precipitation chamber. Thus, a uniform water film is formed on the surface of the insulating members to wash away the particles from waste gas. The condensation-growth chamber is provided for the particles to grow therein and thereby enhances the collection efficiency. The insulating member acts as a shield between the discharge electrodes and the ground electrodes and thereby avoids a short circuit or sparks.

15 Claims, 6 Drawing Sheets

U.S. PATENT DOCUMENTS

| | | | | |
|---|---|---|---|---|
| 6,231,643 | B1 | 5/2001 | Pasic et al. | |
| 6,294,003 | B1 * | 9/2001 | Ray | 96/49 |
| 6,365,112 | B1 * | 4/2002 | Babko-Malyi et al. | 422/186.04 |
| 6,632,267 | B1 * | 10/2003 | Ilmasti | 95/59 |
| 2008/0216659 | A1 * | 9/2008 | Maekawa et al. | 96/44 |

OTHER PUBLICATIONS

Phirun Saiyasitpanich, et al., "Removal of Diesel Particulate Matter (DPM) in a Tubular Wet Electrostatic Precipitator", Journal of Electrostatics 65 (2007), pp. 618-624, Elsevier, Cincinnati, Ohio.

Hyun Ha Kim, et al., "Incinerator Flue Gas Cleaning Using Wet-Type Electrostatic Precipitator", Journal of Chemical Engineering of Japan, 2000, pp. 669-674, vol. 33, No. 4, Japan.

Hosokawa Mikropul, Innovative Wet Electrostatic Precipitator Technology, Filtration & Separation, Jun. 1998, pp. 433-435.

Ralph Altman, et al., "Wet Electrostatic Precipitation Demonstrating Promise for Fine Particulate Control-Part II", Journal of Power Engineering, 2001, pp. 42-44.

Ralph Altman, et al., "Wet Electrostatic Precipitation Demonstrating Promise for Fine Particulate Control-Part I", Journal of Power Engineering, 2001, pp. 38-39.

David J. Bayless, et al., "Membrane-Based Wet Electrostatic Precipitation", Fuel Processing Technology 85 (2004), pp. 781-798, Elsevier, Athens, Ohio.

* cited by examiner

WET ELECTROSTATIC PRECIPITATOR WITH CONDENSATION-GROWTH CHAMBER

BACKGROUND OF THE INVENTION

1. Field of the Invention

The present invention relates to air pollution control equipments and more particularly, to a wet electrostatic precipitation with condensation-growth chamber.

2. Description of the Related Art

U.S. Pat. No. 5,395,430 discloses a wet electrostatic precipitator comprising a housing, an electrostatic precipitator unit, a power supply unit and a cleaning fluid supply unit. The electrostatic precipitator unit comprises a plurality of individual electrostatic precipitators each of which comprises a collector tube and a discharge electrode. The power supply unit is connected with the collector tubes and the discharge electrodes of the electrostatic precipitator unit for causing formation of an electric field. The cleaning fluid supply unit is adapted for holding a cleaning fluid, and delivers the cleaning fluid to above the electrostatic precipitators through a conduit, for enabling the cleaning fluid to flow downwards along the inner wall surface of each collector tube so that a water film is formed on the inner wall surface of each collector tube.

When a waste gas is guided into the collector tubes of the electrostatic precipitators, the discharge electrodes generate an electric corona discharge, causing pollutants in the waste gas to be charged. Subject to electric field effect, the charged pollutants move toward the wall surface of each collector tube. Thereafter, the water film of the cleaning fluid washes the charge-carrying pollutants away from the waste gas.

However, the aforesaid electrostatic precipitator assembly still has drawbacks as follows:

1. It has low efficiency in collecting nanoparticles;
2. The cleaning fluid is not uniformly distributed to form a uniform water film on the whole inner wall surface of each collector, and a part of the inner wall surface of each collector may be kept in a dry status (channeling) and the pollutants that are adhered to the dry surface area in each collector cannot be washed away;
3. There is no shield means between the collector and the discharge electrodes, and a short circuit or sparks may occur via the cleaning fluid, resulting in industrial accidents; and
4. Particles in the waste gas tend to adhere to the discharge electrodes, causing damage of the discharge electrodes and decreasing the corona strength and shortening the service life of the discharge electrodes.

SUMMARY OF THE INVENTION

The present invention has been accomplished under the circumstances in view. It is therefore one object of the present invention to provide a wet electrostatic precipitator, which has a condensation-growth chamber provided therein for the particles to grow therein, thereby enhancing the collection efficiency of nanoparticles.

It is another object of the present invention to provide a wet electrostatic precipitator, which has a uniform water film formed therein to wash away the particles which have been collected on a collector.

It is still another object of the present invention to provide a wet electrostatic precipitator, which avoids a short circuit or sparks, enhancing safe use.

It is still another object of the present invention to provide a wet electrostatic precipitator, which avoids adherence of particles to the discharge electrodes, thereby maintaining corona strength and prolonging the service life.

To achieve these and other objects of the present invention, the wet electrostatic precipitator comprises a condensation-growth chamber, a precipitation chamber, at least one discharge electrode, at least one insulating member and at least one ground electrode. The condensation-growth chamber comprises a first enclosed cavity and a waste gas inlet. The waste gas inlet extends from the first enclosed cavity to the outside of the condensation-growth chamber. The precipitation chamber comprises a second enclosed cavity, a gas outlet, at least one liquid intake passage and at least one liquid return passage. The second enclosed cavity is in communication with the first enclosed cavity. The gas outlet and the at least one liquid intake passage and the at least one liquid return passage extend from the second enclosed cavity to the outside of the precipitation chamber. The at least one discharge electrode is mounted in the second enclosed cavity of the precipitation chamber. The at least one insulating member is made of a non-conducting material and arranged on the inner wall of the second enclosed cavity of the precipitation chamber below the at least one liquid intake passage. The at least one ground electrode is mounted in the precipitation chamber at an outer side relative to the at least one insulating member.

Further, the first enclosed cavity of the condensation-growth chamber comprises a heating region and a cooling region. The heating region is connected between the waste gas inlet and the cooling region. The cooling region is connected to the second enclosed cavity of the precipitation chamber. The wet electrostatic precipitator further comprises a nebulizer and a heater. The nebulizer is mounted in the condensation-growth chamber near the waste gas inlet. The heater is mounted in the condensation-growth chamber near the heating region of the first enclosed cavity.

Further, each insulating member has a coarse surface or hydrophilic surface. The number of the at least one insulating member can be 2, and the two insulating members are arranged at two sides relative to the at least one discharge electrode. The number of the at least one ground electrode can be 2, and the two ground electrodes are arranged at two sides relative to the at least one insulating member. Further, each insulating member can be an annular member surrounding one respective discharge electrode, and each ground electrode can be an annular electrode surrounding one respective insulating member. The wet electrostatic precipitator further comprises at least one baffle mounted on an inner wall surface of the precipitation chamber between the second enclosed cavity and the at least one liquid return passage. Further, the precipitation chamber comprises at least one chamber disposed between the second enclosed cavity and the at least one liquid intake passage. Further, each liquid intake passage of the precipitation chamber has provided therein an accommodation tank to have the collected cleaning fluid be uniformly distributed therein.

The wet electrostatic precipitator further comprises at least one ultrasonic vibrator connected to the at least one discharge electrode and at least one dual-sleeve member. Each dual-sleeve member comprises an outer sleeve and an inner sleeve. The outer sleeve is disposed in the precipitation chamber. The inner sleeve is inserted into the outer sleeve for receiving one discharge electrode. The outer sleeve and the inner sleeve define therebetween a jet passage. The jet passage has an outlet around the at least one discharge electrode. Further, each discharge electrode extends in parallel or perpendicular to the flow direction of the waste gas. Further, each discharge electrode can be affixed to the inside of the inner sleeve of one respective dual-sleeve member through a rod member.

DETAILED DESCRIPTION OF THE INVENTION

Figure 1:
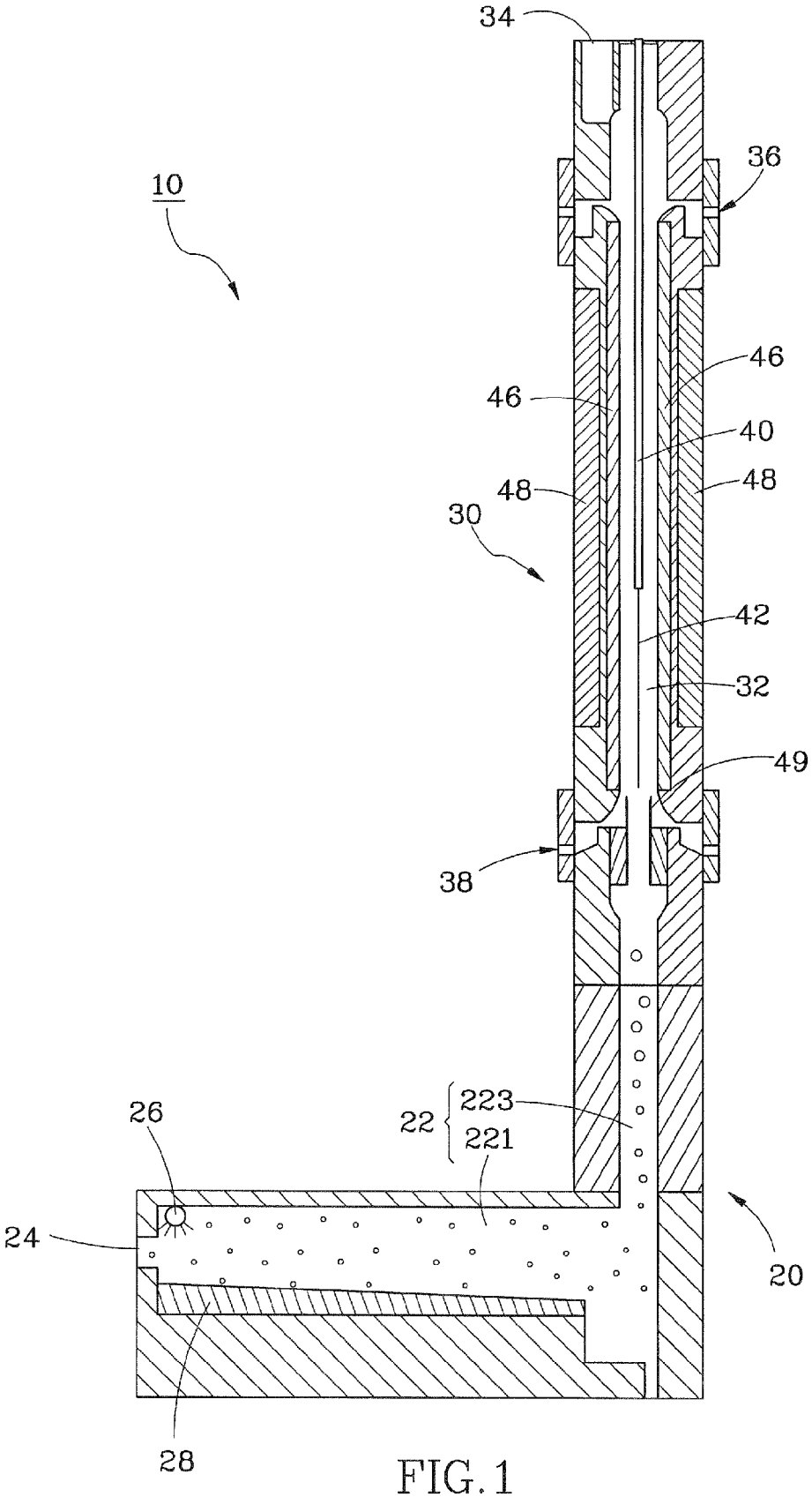
FIG. 1 is a sectional view of a wet electrostatic precipitator in accordance with a first embodiment of the present invention.

Referring to FIG. 1, a wet electrostatic precipitator 10 in accordance with a first embodiment of the present invention is adapted for treating a waste gas, comprising a condensation-growth chamber 20, a nebulizer 26, a heater 28, a precipitation chamber 30, three dual-sleeve members 40, three discharge electrodes 42, three ultrasonic vibrators 44, two insulating members 46, two ground electrodes 48 and two baffles 49.

The condensation-growth chamber 20 defines a first enclosed cavity 22 and a waste gas inlet 24. The first enclosed cavity 22 has a heating region 221 and a cooling region 223. The waste gas inlet 24 extends from the heating region 221 to the outside of the condensation-growth chamber 20.

The nebulizer 26 is mounted inside the condensation-growth chamber 20 near the waste gas inlet 24 and adapted for spraying a water mist toward the heating region 221 of the condensation-growth chamber 20 to enhance the humility to a saturated status.

The heater 28 is mounted in the condensation-growth chamber 20 at the bottom side of the heating region 221 of the first enclosed cavity 22.

The waste gas to be treated is guided through the waste gas inlet 24 into the heating region 221 of the first enclosed cavity 22 where the waste gas is heated by the heater 28. At the same time, the water mist sprayed by the nebulizer 26 is vaporized and mixed with the waste gas. Thereafter, the waste gas and the steam enter the cooling region 223 and are cooling down. Following dropping of temperature, the steam in the cooling region 223 will become over-saturated and condensed on the surface of the particles in the waste gas, causing the particles to grow.

Figure 2:
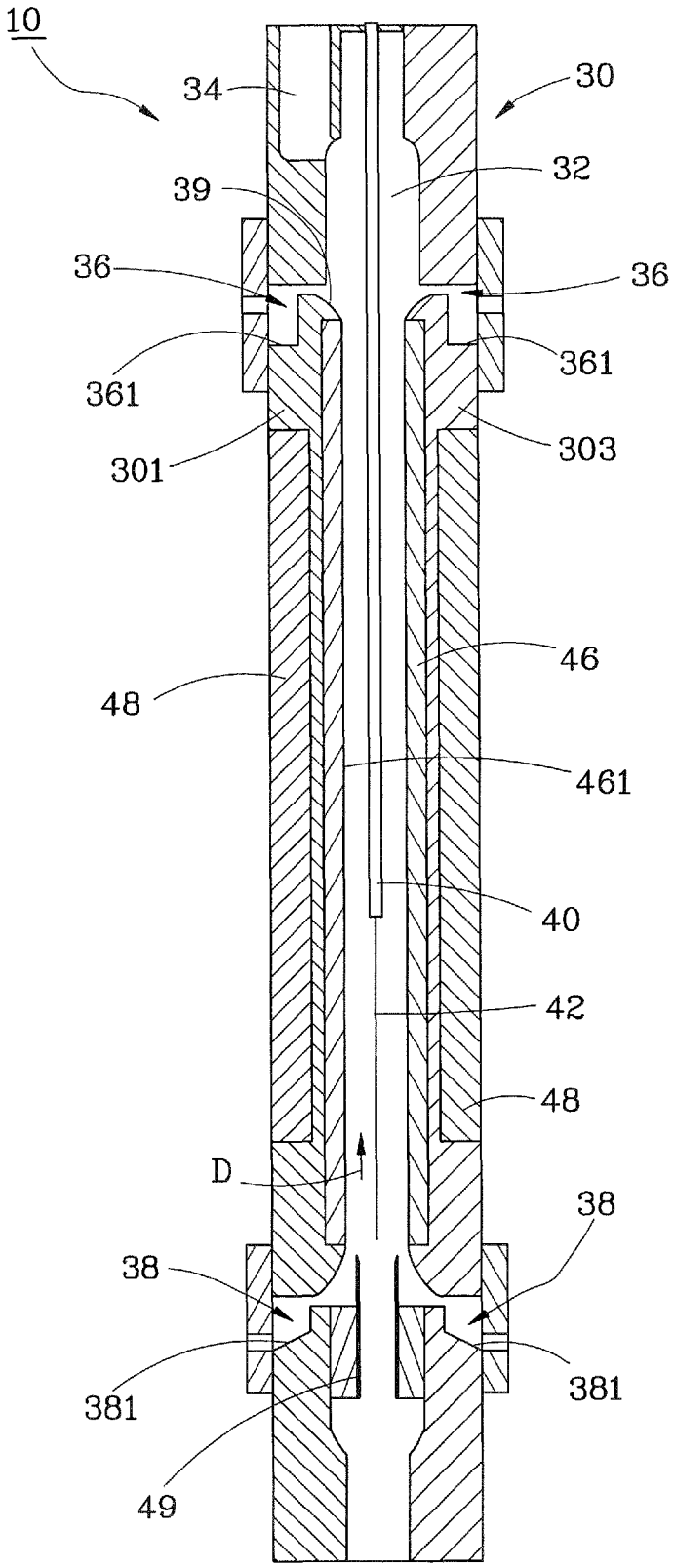
FIG. 2 is an enlarged view of a part of FIG. 1, showing the arrangement of the precipitation chamber and its internal parts.
Figure 3:
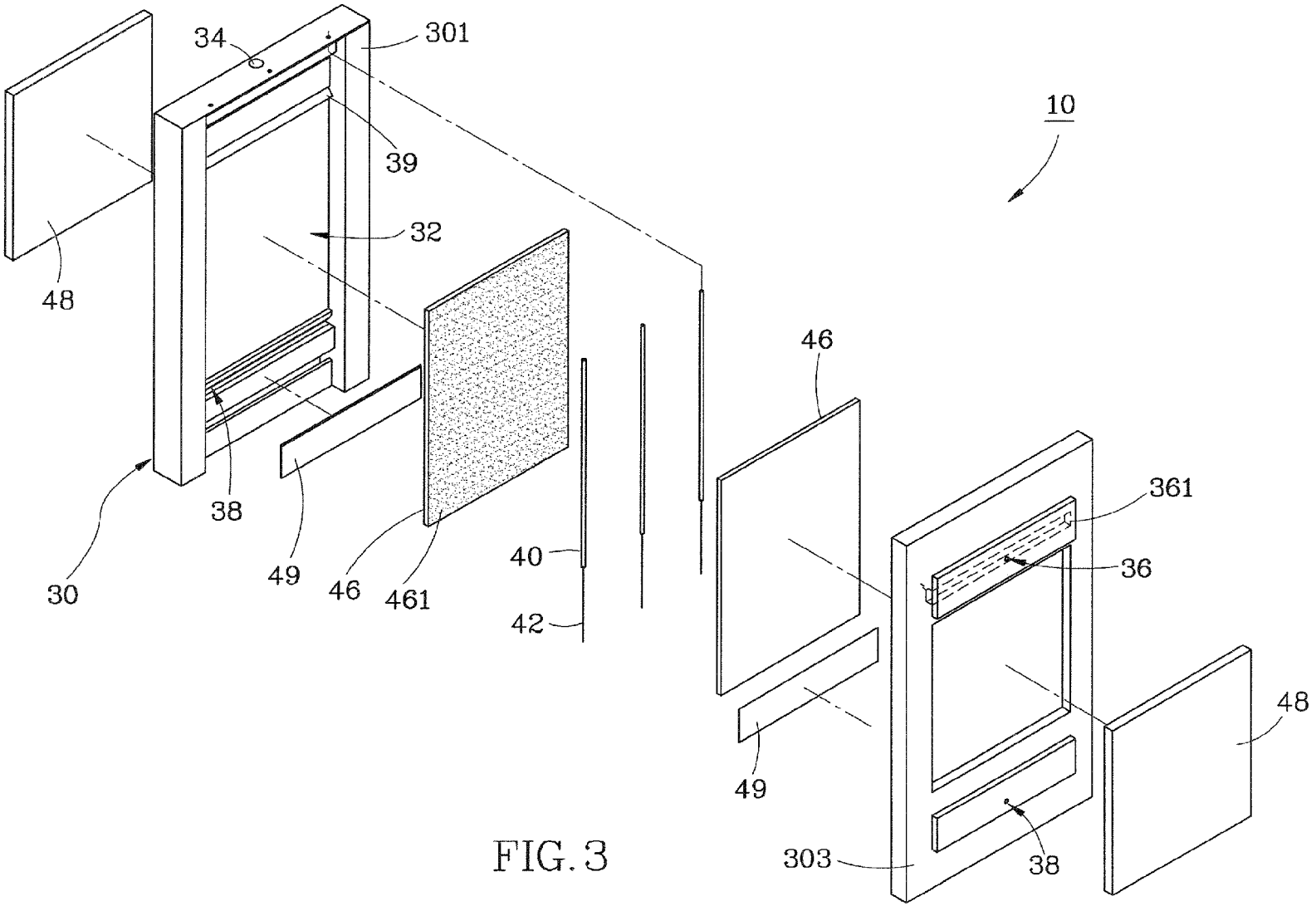
FIG. 3 is an exploded view of the precipitation chamber and the related internal parts of the wet electrostatic precipitator in accordance with a first embodiment of the present invention.

Referring to FIGS. 2 and 3, the precipitation chamber 30 is formed of a left cover 301 and a right cover 303. The left cover 301 and the right cover 303 are made of acrylics or any other temperature-resistant and acid-resistant and alkali-resistant material. The precipitation chamber 30 comprises a second enclosed cavity 32, a gas outlet 34, two liquid intake passages 36, two liquid return passages 38 and two chamfers 39. The second enclosed cavity 32 is in communication with the cooling region 223 of the first enclosed cavity 32. The waste gas flows through the second enclosed cavity 32 along a flow direction D. The gas outlet 34, the liquid intake passages 36 and the liquid return passages 38 are respectively extended from the second enclosed cavity 32 to the outside of the precipitation chamber 30. The liquid intake passages 36 and the liquid return passages 38 are respectively connected to a cleaning fluid supply tank (not shown). The cleaning fluid supply tank is adapted for holding a cleaning fluid. The liquid intake passages 36 deliver the cleaning fluid from the cleaning fluid supply tank to the second enclosed cavity 32, allowing the cleaning fluid to flow downwards along the inside wall of the second enclosed cavity 32. The liquid return passages 38 guide the cleaning fluid from the second enclosed cavity 32 backwards to the cleaning fluid supply tank for recycling. Each liquid return passage 38 is provided therein a collection tank 381 for collecting the cleaning fluid that flowed down along the wall of the second enclosed cavity 32. Further, each liquid intake passage 36 is provided therein an accommodation tank 361. The accommodation tank 361 has a predetermined width so that the collected cleaning fluid is uniformly distributed in the accommodation tank 361 and then guided to the second enclosed cavity 32. The two chamfers 39 are respectively provided between the second enclosed cavity 32 and the liquid intake passages 36 for guiding the cleaning fluid into the second enclosed cavity 32 smoothly.

Figure 4:
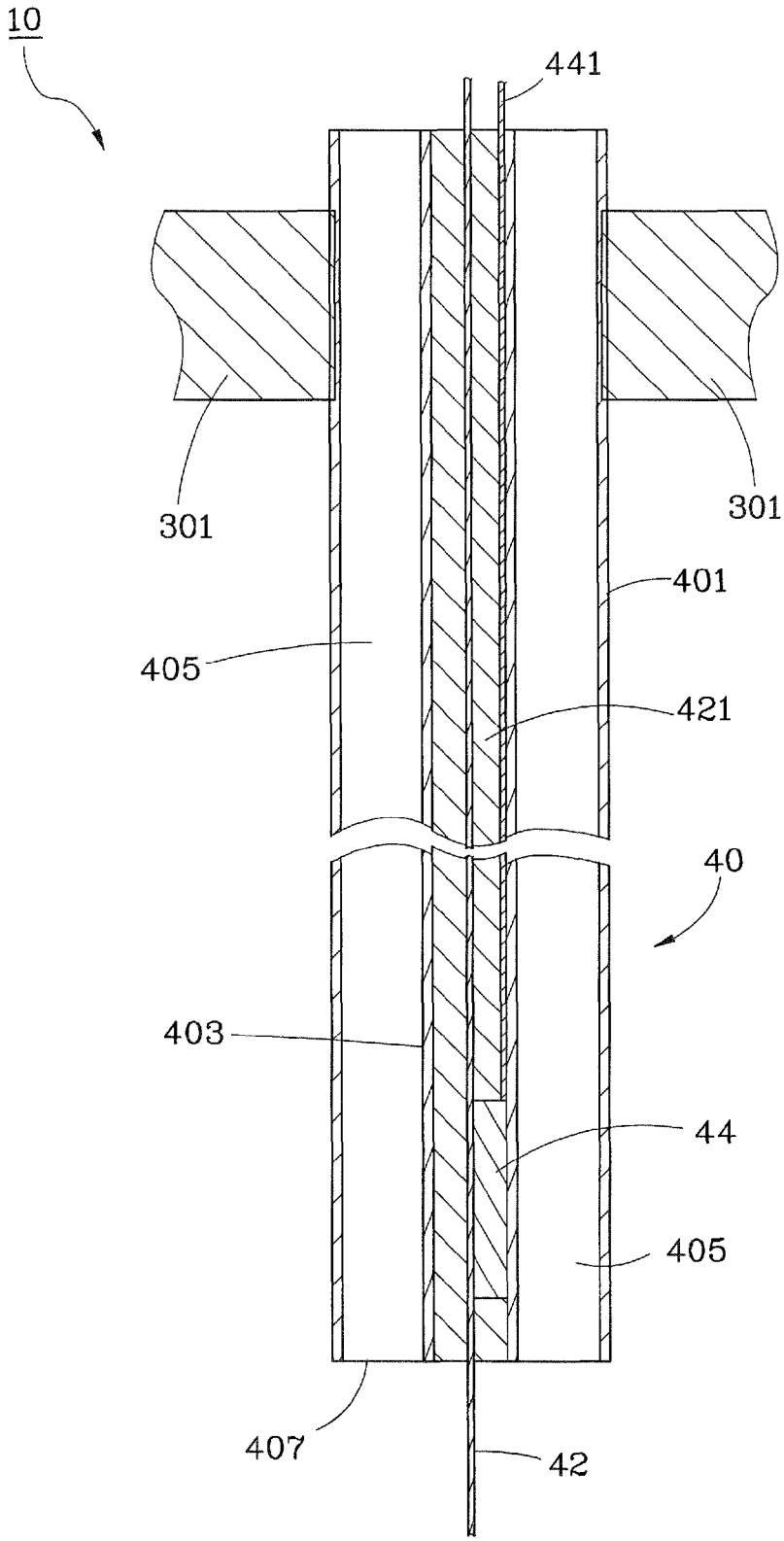
FIG. 4 is an enlarged view of a part of FIG. 1, showing the structure of the discharge electrode and the dual-sleeve members.

Referring to FIG. 4, the dual-sleeve members 40 are respectively mounted in the second enclosed cavity 32 of the precipitation chamber 30, each comprising an outer sleeve 401, an inner sleeve 403 and a jet passage 405. The top end of the outer sleeve 401 is fastened to the top of the left cover 301 of the precipitation chamber 30 by a screw joint. The inner sleeve 403 is inserted into the outer sleeve 401. The jet passage 405 is defined in between the outer sleeve 401 and the inner sleeve 403. The jet passage 405 has its top end connected to a clean air source (not shown) and its bottom end terminating in an outlet 407.

The discharge electrodes 42 are linear metal members arranged in the second enclosed cavity 32, and respectively fastened to the inner side of the inner sleeve 403 of each of the dual-sleeve members 40 with a respective rod member 421. The rod members 421 are made of an electrically insulative material. Further, the discharge electrodes 42 extend in parallel to the flow direction D of the waste gas. Further, the outlets 407 of the jet passages 405 of the dual-sleeve members 40 are respectively disposed around the discharge electrodes 42.

The ultrasonic vibrators 44 are respectively mounted in the inner sleeves 403 of the dual-sleeve members 40 and respectively connected with the discharge electrodes 42. Further, the ultrasonic vibrators 44 obtain the necessary voltage through a conductive wire 441.

Referring to FIGS. 2 and 3, the insulating members 46 are made of glass in the shape of a rectangular plate and arranged on the wall surface of the second enclosed cavity 32 of the precipitation chamber 30. The two insulating members 46 are arranged at two opposite sides relative to the discharge electrodes 42 under the liquid intake passages 36, each having a coarse surface 461 formed through a sand blast treatment. Further, the coarse surface 461 may be coated with a layer of titanium dioxide coating and radiated with ultraviolet light to cause a photocatalytic reaction so that the coarse surface 461 can form a hydrophilic surface.

The two ground electrodes 48 are mounted on the outer wall surface of the precipitation chamber 30 on the outside of the two insulating members 46. The discharge electrodes 42 and the ground electrodes 48 are respectively connected to a high voltage DC power source (not shown) so that an electric field is formed between the discharge electrodes 42 and the ground electrodes 48.

The two baffles 49 are respectively mounted on the inner wall surface of the precipitation chamber 30 between the second enclosed cavity 32 and the two liquid return passages 38 to smoothen flow of the cleaning fluid into the two liquid return passages 38.

When the high voltage DC power source is providing a high voltage direct current to cause an electric field between the discharge electrodes 42 and the ground electrodes 48, the discharge electrodes 42 generate corona discharge, causing the particles in the waste gas to be charged and to move toward the insulating members 46. At the same time, the cleaning fluid goes through the liquid intake passages 36 and chamfers 39 of the precipitation chamber 30 into the second enclosed cavity 32, and then flows downwards along the surfaces 461 of the insulating members 46 in the form of a water film to wash away the charged particles from the waste gas before touching the insulating members 46, purifying the waste gas. The purified gas is then expelled to the outside through the gas outlet 34.

Because the wet electrostatic precipitator 10 has the particles in the waste gas grow in the condensation-growth chamber and then has the particles washed away after an increase of the particle size, the collection efficiency of deep-submicron particles is effectively enhanced. Further, the coarse surface 461 of each insulating member 46 is a hydrophilic surface, facilitating the formation of a uniform water film on the coarse surface 461 with the cleaning fluid for washing away the particles from the waste gas. Further, the insulating members 46 are made of a non-conducting material and set between the discharge electrodes 42 and the ground electrodes 48, avoiding a short circuit or sparks during flowing of the cleaning fluid and enhancing safe use. Further, the jet passages 405 of the dual-sleeve members 40 guide clean air into the second enclosed cavity 32 to surround the discharge electrodes 42, forming a shield, avoiding a short circuit or sparks between the discharge electrodes 42 and the ground electrodes 48. The ultraviolet vibrators 44 are adapted to shake particles away from the discharge electrodes 42, avoiding adherence of particles to the discharge electrodes 42 and maintaining electric corona strength and prolonging the service life.

Figure 5:
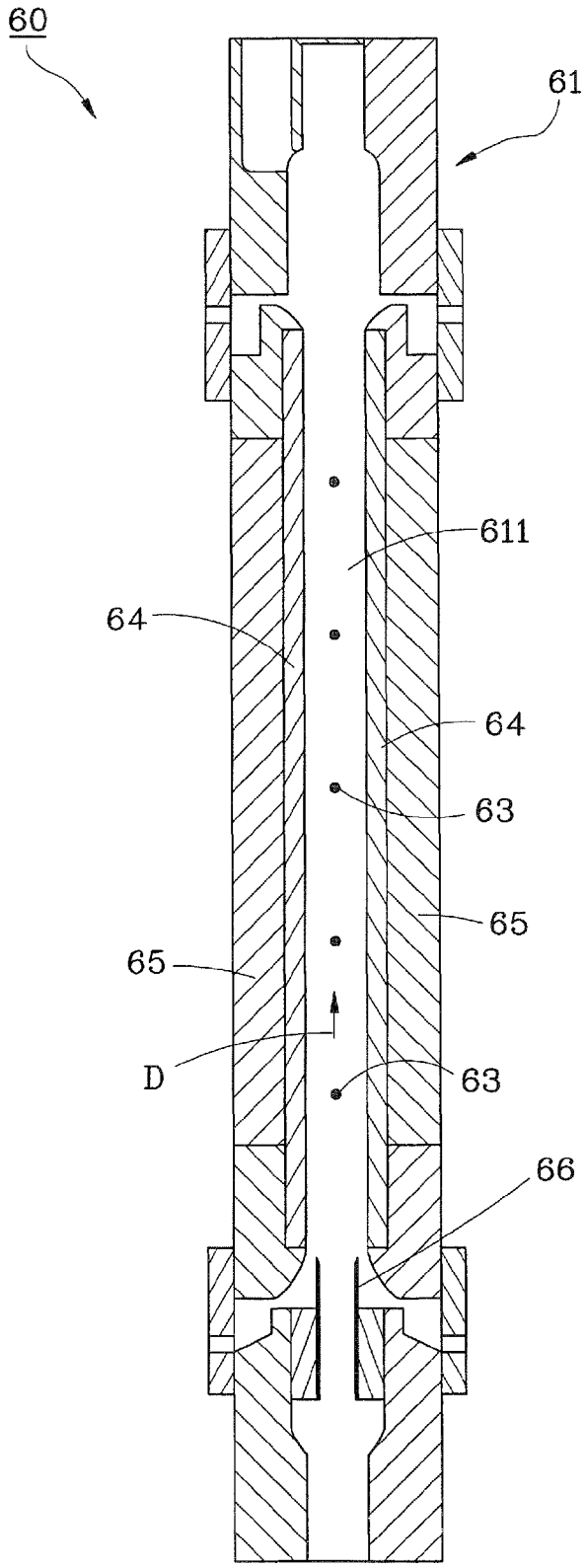
FIG. 5 is a sectional view of a precipitation chamber and related internal parts for a wet electrostatic precipitator in accordance with a second embodiment of the present invention.

Based on the spirit of the invention, the wet electrostatic precipitator may be variously embodied. FIG. 5 illustrates a wet electrostatic precipitator 60 in accordance with a second embodiment of the present invention. This second embodiment is substantially similar to the aforesaid first embodiment with the exception that the extending direction of the discharge electrodes 63 is perpendicular to the flow direction D of the waste gas. Further, this second embodiment eliminates the aforesaid dual-sleeve members.

Figure 6:
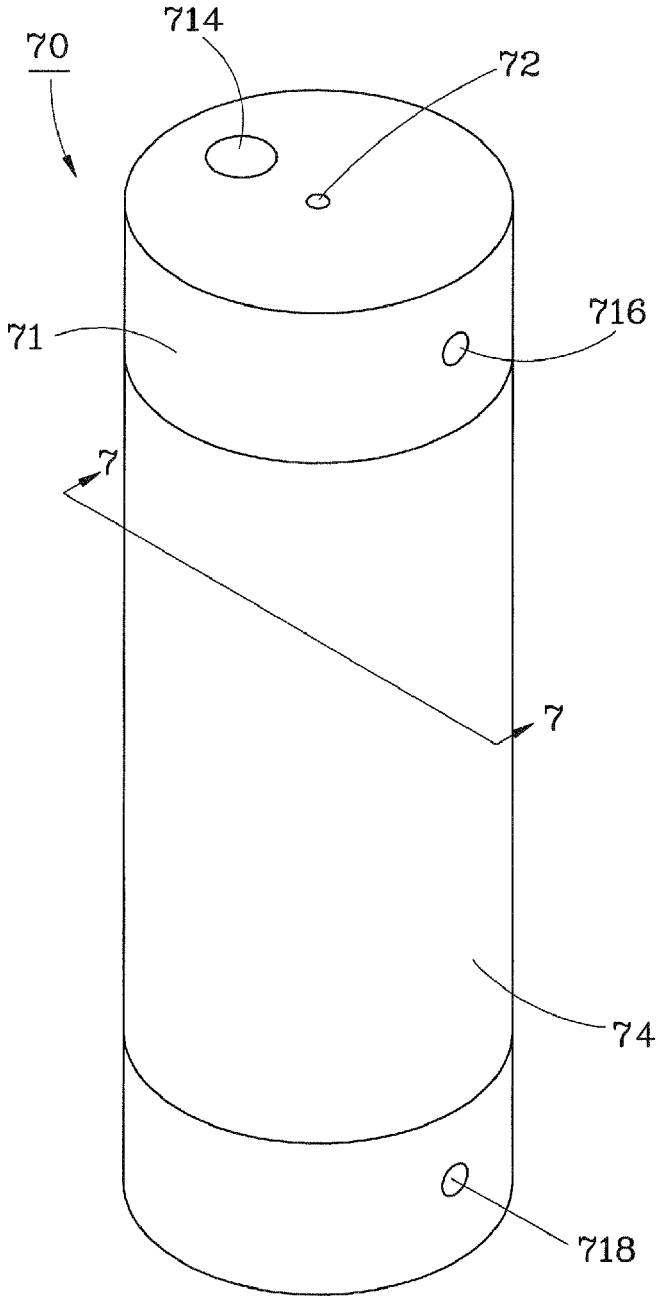
FIG. 6 is a perspective view of a precipitation chamber and a ground electrode for a wet electrostatic precipitator in accordance with a third embodiment of the present invention.
Figure 7:
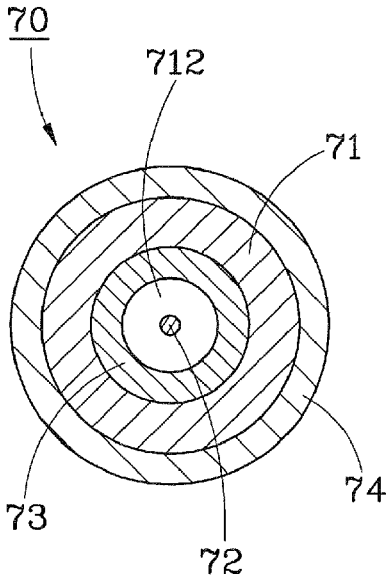
FIG. 7 is a sectional view taken along line 7-7 of FIG. 6.

FIGS. 6 and 7 show a wet electrostatic precipitator 70 in accordance with a third embodiment of the present invention. This third embodiment is substantially similar to the aforesaid first embodiment with the exception that the precipitation chamber 71 of the wet electrostatic precipitator 70 is shaped like a round tube and has only one liquid intake passage 716 and one liquid return passage 718; the wet electrostatic precipitator 70 has only one discharge electrode 72, one insulating member 73 and one ground electrode 74; the insulating member 73 is an annular member surrounding the discharge electrode 72; the ground electrode 74 is an annular member mounted on the outside wall of the precipitation chamber 71 around the insulating member 73.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A wet electrostatic precipitator adapted for purifying a waste gas, comprising:

a condensation-growth chamber, said condensation-growth chamber comprising a first enclosed cavity and a waste gas inlet, said waste gas inlet extending from said first enclosed cavity to the outside of said condensation-growth chamber;

a precipitation chamber, said precipitation chamber comprising a second enclosed cavity, a gas outlet, at least one liquid intake passage and at least one liquid return passage, said second enclosed cavity being in communication with said first enclosed cavity, said gas outlet and said at least one liquid intake passage and said at least one liquid return passage extending from said second enclosed cavity to the outside of said precipitation chamber;

at least one discharge electrode mounted in said second enclosed cavity of said precipitation chamber;

at least one insulating member made of a non-conducting material and arranged on the inner wall of said precipitation chamber below said at least one liquid intake passage; and at least one ground electrode mounted on said precipitation chamber at an outer side relative to said at least one insulating member.

2. The wet electrostatic precipitator as claimed in claim 1, wherein said first enclosed cavity of said condensation-growth chamber comprises a heating region and a cooling region, said heating region being connected between said waste gas inlet and said cooling region, said cooling region being connected to said second enclosed cavity of said precipitation chamber.

3. The wet electrostatic precipitator as claimed in claim 2, wherein said wet electrostatic precipitator further comprises a nebulizer being mounted in said condensation-growth chamber near said waste gas inlet.

4. The wet electrostatic precipitator as claimed in claim 2, wherein said wet electrostatic precipitator further comprises a heater being mounted in said condensation-growth chamber near said heating region of said first enclosed cavity.

5. The wet electrostatic precipitator as claimed in claim 1, wherein said at least one insulating member has a coarse surface.

6. The wet electrostatic precipitator as claimed in claim 1, wherein said at least one insulating member has a hydrophilic surface.

7. The wet electrostatic precipitator as claimed in claim 1, wherein said at least one insulating member is an annular member surrounding said at least one discharge electrode.

8. The wet electrostatic precipitator as claimed in claim 1, wherein said at least one ground electrode is an annular electrode surrounding said at least one insulating member.

9. The wet electrostatic precipitator as claimed in claim 1, wherein said at least one ground electrode is mounted on the outer wall surface of the precipitation chamber.

10. The wet electrostatic precipitator as claimed in claim 1, further comprising at least one baffle mounted on an inner wall surface of said precipitation chamber between said second enclosed cavity and said at least one liquid return passage.

11. The wet electrostatic precipitator as claimed in claim 1, wherein said precipitation chamber comprises at least one chamfer disposed between said second enclosed cavity and said at least one liquid intake passage.

12. The wet electrostatic precipitator as claimed in claim 1, further comprising at least one ultrasonic vibrator connected to said at least one discharge electrode.

13. The wet electrostatic precipitator as claimed in claim 1, further comprising at least one dual-sleeve member, each said dual-sleeve member comprising an outer sleeve and an inner sleeve, said outer sleeve being disposed in said precipitation chamber, said inner sleeve being inserted into said outer sleeve for receiving one said discharge electrode, said outer sleeve and said inner sleeve defining therebetween a jet passage, said jet passage having an outlet around one said discharge electrode.

14. The wet electrostatic precipitator as claimed in claim 1, wherein the waste gas is guided through said second enclosed cavity of said precipitation chamber in a predetermined flow direction; each said discharge electrode extends in parallel to said flow direction.

15. The wet electrostatic precipitator as claimed in claim 1, wherein the waste gas is guided through said second enclosed cavity of said precipitation chamber in a predetermined flow direction; each said discharge electrode extends perpendicular to said flow direction.

* * * * *